US006963276B2

(12) United States Patent
Chen

(10) Patent No.: US 6,963,276 B2
(45) Date of Patent: Nov. 8, 2005

(54) CARD-TYPE ANTI-MISS/ANTI-THEFT ALARM DEVICE

(76) Inventor: Chung-Yang M. Chen, 3F, No. 2, Lane 497, Chung-Cheng Rd., Hsintien City, Taipei County (TW)

( * ) Notice: Subject to any disclaimer, the term of this patent is extended or adjusted under 35 U.S.C. 154(b) by 58 days.

(21) Appl. No.: 10/385,700

(22) Filed: Mar. 12, 2003

(65) Prior Publication Data

US 2004/0155774 A1 Aug. 12, 2004

(30) Foreign Application Priority Data

Feb. 12, 2003 (CN) ..... 3228761

(51) Int. Cl.[7] ..... G08B 23/00

(52) U.S. Cl. ..... 340/501; 340/506; 340/568.1; 340/568.7; 340/573.1; 340/568.5; 340/568.6; 340/568.8

(58) Field of Search ..... 340/501, 506, 340/568.1, 571, 568.7, 573.1, 568.5, 568.6, 568.8

(56) References Cited

U.S. PATENT DOCUMENTS 5,781,109 A * 7/1998 Nakajima ..... 340/571
5,796,338 A * 8/1998 Mardirossian ..... 340/568.1
5,963,131 A * 10/1999 D'Angelo et al. ..... 340/568.1
6,011,471 A * 1/2000 Huang ..... 340/568.1
6,014,079 A * 1/2000 Huang ..... 340/571
6,057,762 A * 5/2000 Dusza ..... 340/568.6
6,265,974 B1 * 7/2001 D'Angelo et al. ..... 340/568.1
6,620,057 B1 * 9/2003 Pirritano et al. ..... 473/353
2004/0155777 A1 * 8/2004 Mitchell et al. ..... 340/568.1

FOREIGN PATENT DOCUMENTS

GB 2236 000 A * 3/1991
GB 2236000 A * 3/1991 ..... G08B/13/00

* cited by examiner

*Primary Examiner*—Jeffery Hofsass
*Assistant Examiner*—Daniel Previl
(74) *Attorney, Agent, or Firm*—Troxell, Law Office, PLLC

(57) ABSTRACT

Card-type anti-miss/anti-theft alarm device including a portable mainframe and an alarm sub-frame each having a central processing/controlling unit and a power supply unit. One of the portable mainframe and alarm sub-frame includes an intermittent oscillating transmission unit, while the other includes a signal receiving unit and a sonic/optical warning unit. The alarm sub-frame is designed as a thin card with a dimension smaller than or equal to that of an existent credit card, whereby the alarm sub-frame can be easily placed and hidden in an article carried by a user. In case the user misses the article or the article is stolen by a thief and spaced from the user by a certain distance, at least one of the portable mainframe and the alarm sub-frame can emit an alarm to indicate the user of the location of the missing article. Accordingly, the user can easily find the article and the thief is scared.

4 Claims, 7 Drawing Sheets

CARD-TYPE ANTI-MISS/ANTI-THEFT ALARM DEVICE

BACKGROUND OF THE INVENTION

The present invention is related to a card-type anti-miss/anti-theft alarm device including a portable mainframe and an alarm sub-frame. The alarm sub-frame is designed as a thin card with a dimension smaller than or equal to that of an existent credit card, whereby the alarm sub-frame can be easily placed and hidden in a small-size article carried with a user, such as a wallet, a suitcase, a portable computer, etc. In case the user misses the article or the article is stolen by a thief and spaced from the user by a certain distance, an alarm is emitted to warn the user.

It often takes place that a person misses a portable article or even a kid in a hurry. In order to solve this problem, a portable detection alarm has been developed. Such detection alarm includes a tracing transmitter and a cooperative receiving alarm. The transmitter continuously transmits intermittent a signal of a certain frequency for the receiving alarm to receive. In case the transmitter is spaced from the receiving alarm by a distance exceeding the monitoring range and the receiving alarm can hardly receive the signal, an internal alarm is driven to emit an alarm. In use, the tracing transmitter and the receiving alarm are respectively placed in a user and a portable article or a kid. The activation of the alarm is determined by whether the distance between the tracing transmitter and the receiving alarm exceeds the preset distance. The alarm is able to prevent the user from missing the article or the kid.

However, the tracing transmitter and the receiving alarm of the above portable detection alarm have large volumes so that it is inconvenient to carry such alarm device and the alarm device can be hardly well hidden. Also, the application of such detection alarm is quite limited. Such detection alarm is only applicable to specific large-size article and is easy to be found a thief. As a result, the thief can easily disassemble the alarm and make the user hard to locate the article.

SUMMARY OF THE INVENTION

It is therefore a primary object of the present invention to provide a card-type anti-miss/anti-theft alarm device including a portable mainframe and an alarm sub-frame. The alarm sub-frame is designed as a thin card with a dimension smaller than or equal to that of an existent credit card, whereby the alarm sub-frame can be easily placed in or sandwiched between layers of a small-size article carried with a user. Accordingly, the alarm sub-frame can be well hidden and more mobilely used. A thief can hardly find the alarm device and disassemble the same.

The present invention can be best understood through the following description and accompanying drawings wherein:

DETAILED DESCRIPTION OF THE PREFERRED EMBODIMENTS

Figure 1A:
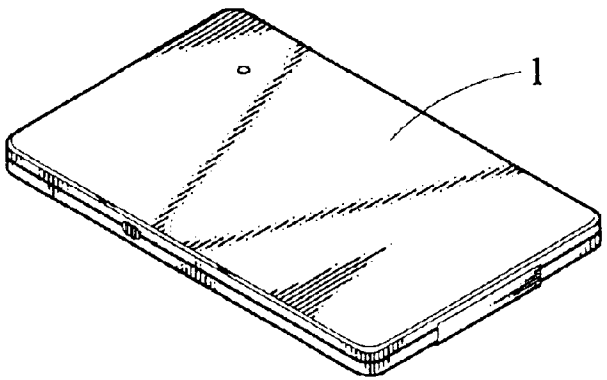
FIG. 1A is a perspective view of the portable mainframe of the present invention.
Figure 1B:
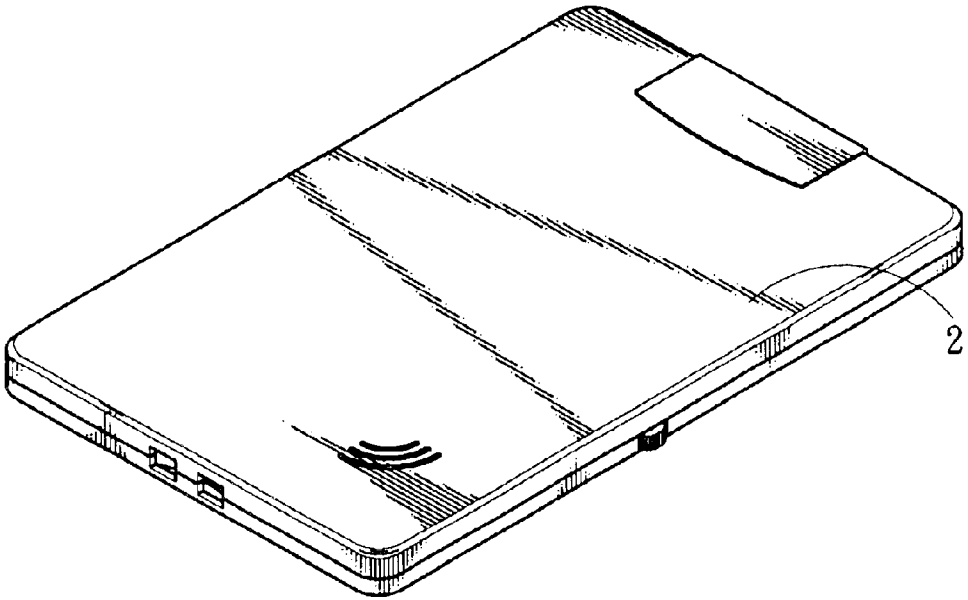
FIG. 1B is a perspective view of the alarm sub-frame of the present invention.
Figure 2:
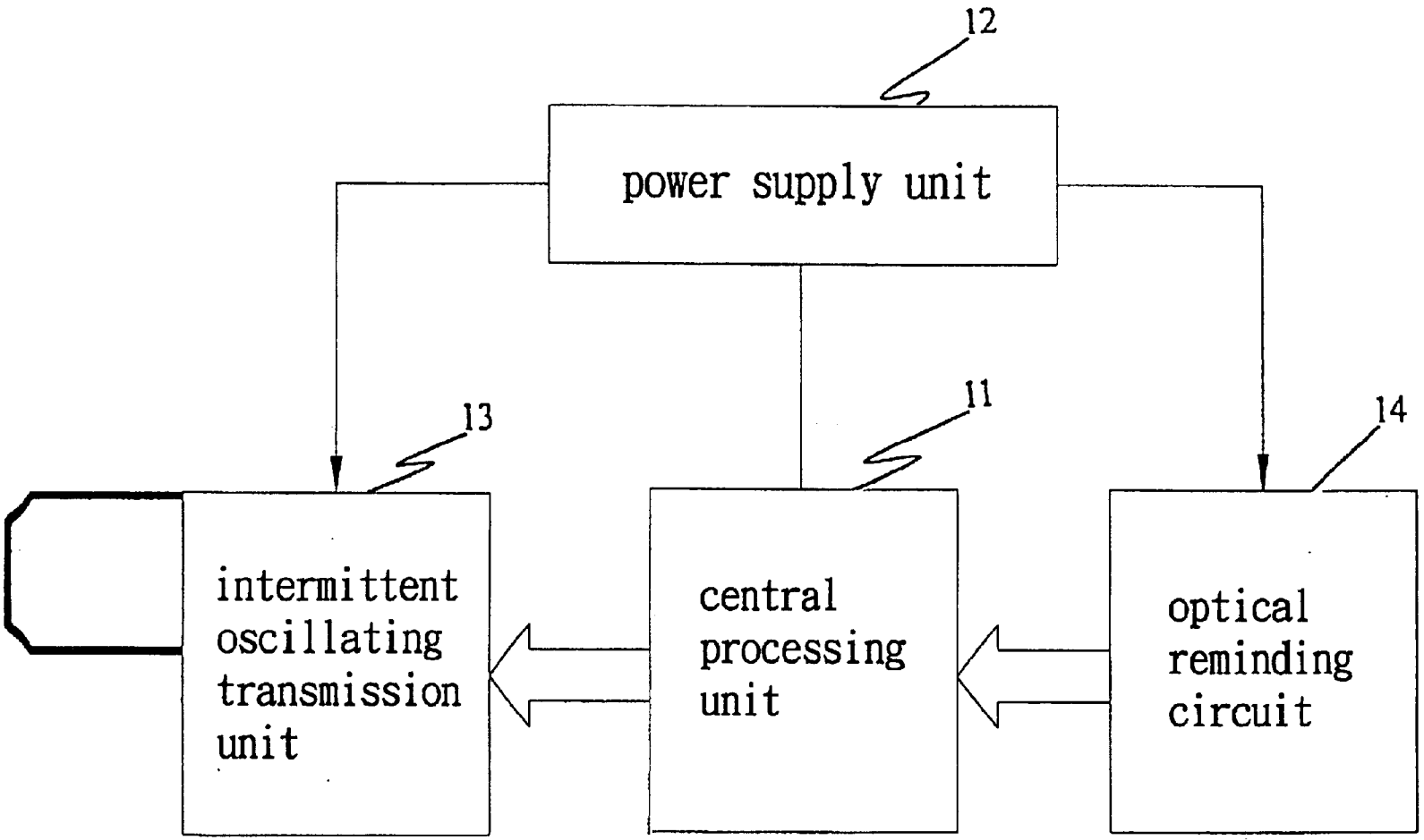
FIG. 2 is a block circuit diagram view of the portable mainframe of the present invention.
Figure 3:
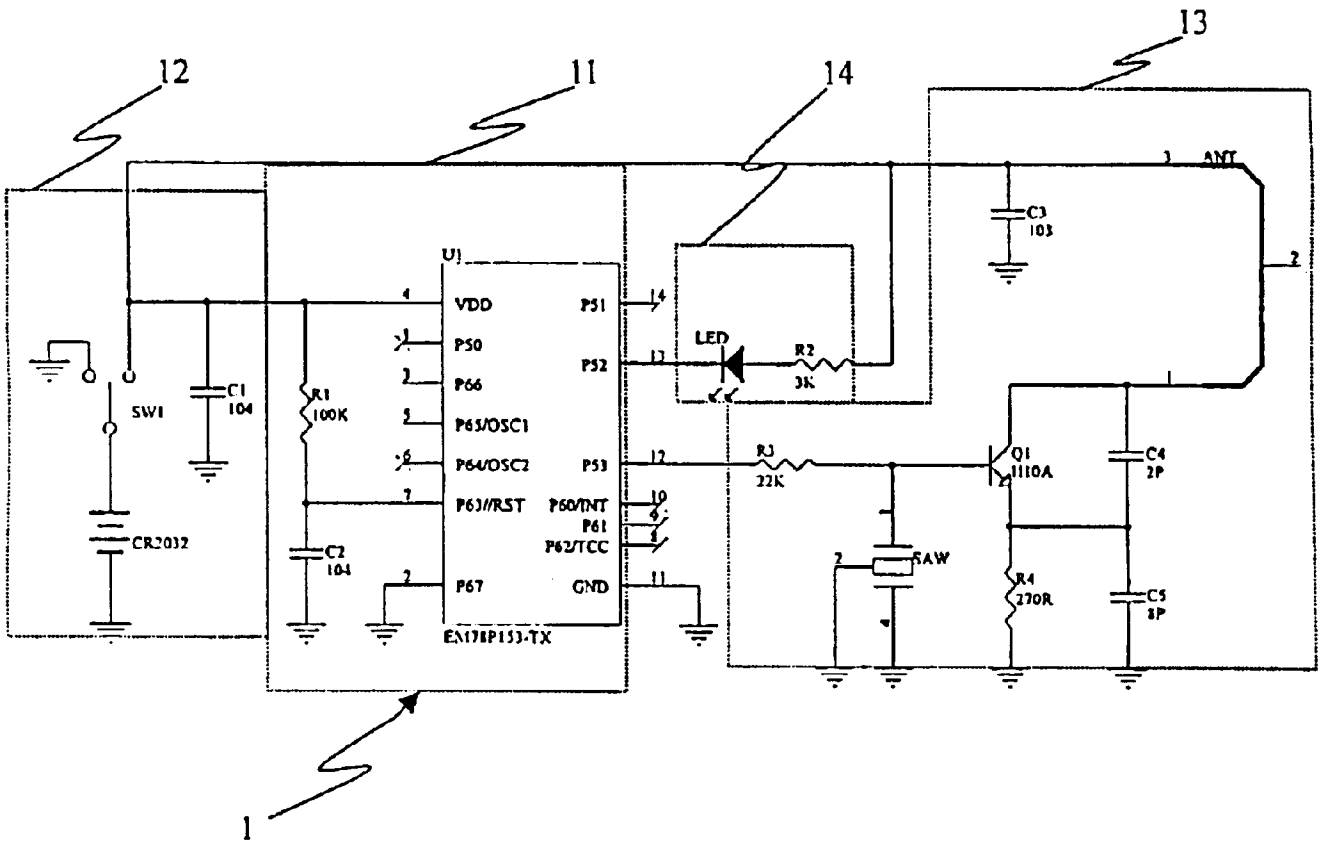
FIG. 3 is a circuit diagram view of the portable mainframe of the present invention.

Please refer to FIGS. 1 to 4. The card-type anti-miss/anti-theft alarm device of the present invention includes a portable mainframe 1 and an alarm sub-frame 2. A user can hang or place the portable mainframe 1 on his/her body 30. The mainframe 1 is designed as a small thin sheet. The alarm sub-frame 2 is designed as a thin card. The dimension of the alarm sub-frame 2 is smaller than that of an existent credit card so that the alarm sub-frame 2 can be easily placed into a small article 40 such as a wallet or sandwiched between layers of an important article. Accordingly, the alarm sub-frame 2 can be hidden in the article and easily carried. FIGS. 2 and 3 show the circuit block diagram and circuit diagram of the portable mainframe 1. A central processing/controlling unit 11 serves as a control center of the mainframe 1. A power supply unit 12 supplies power for all the components of the mainframe 1. An intermittent oscillating transmission unit 13 receives the signal coming from the central processing/controlling unit 11 to intermittently transmit a high frequency radio signal wave. An optical reminding circuit 14 serves to emit a flickering signal for reminding a user to replace the power source in the case of weak power.

Figure 4:
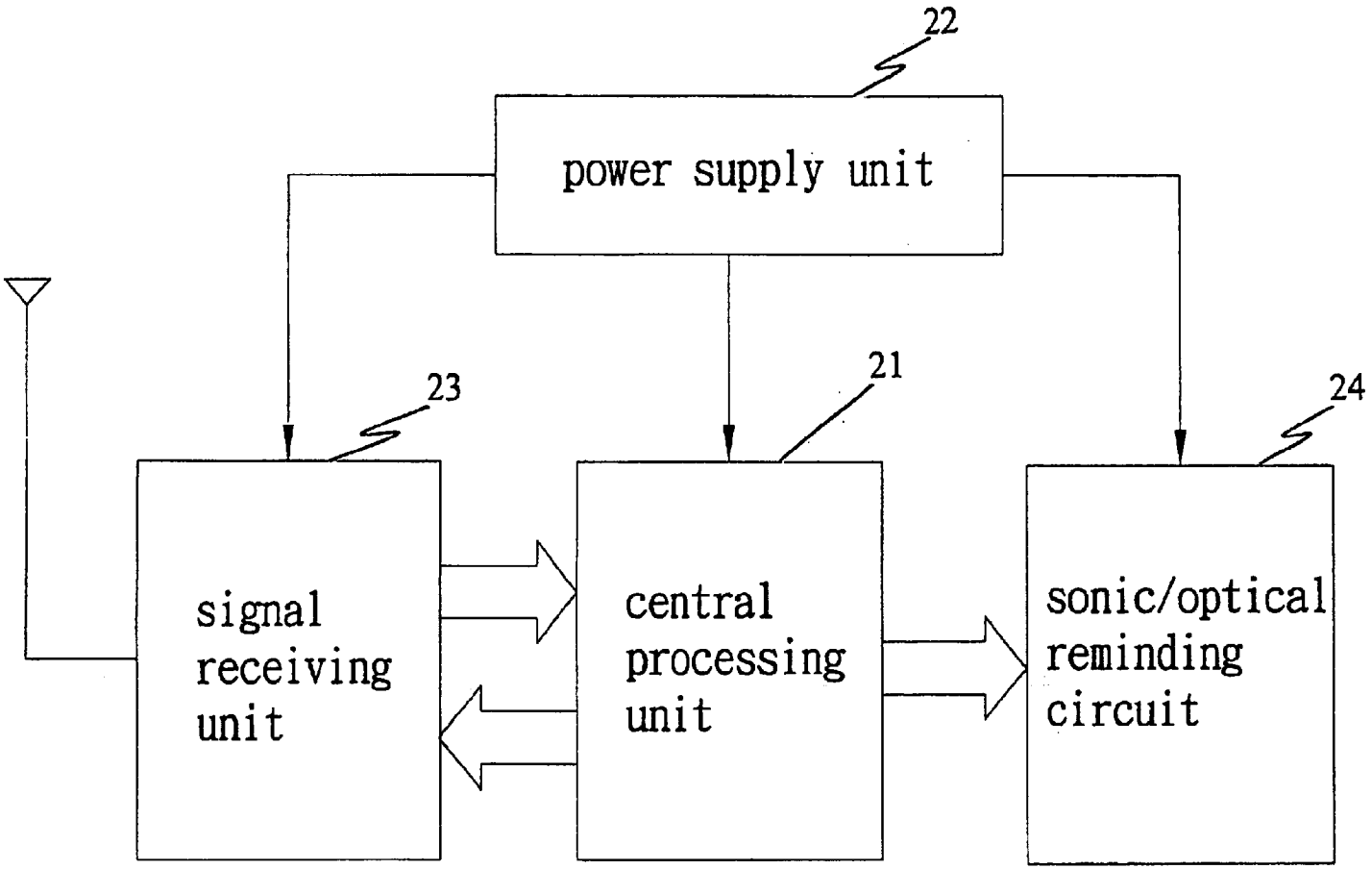
FIG. 4 is a block circuit diagram view of the alarm sub-frame of the present invention.
Figure 5:
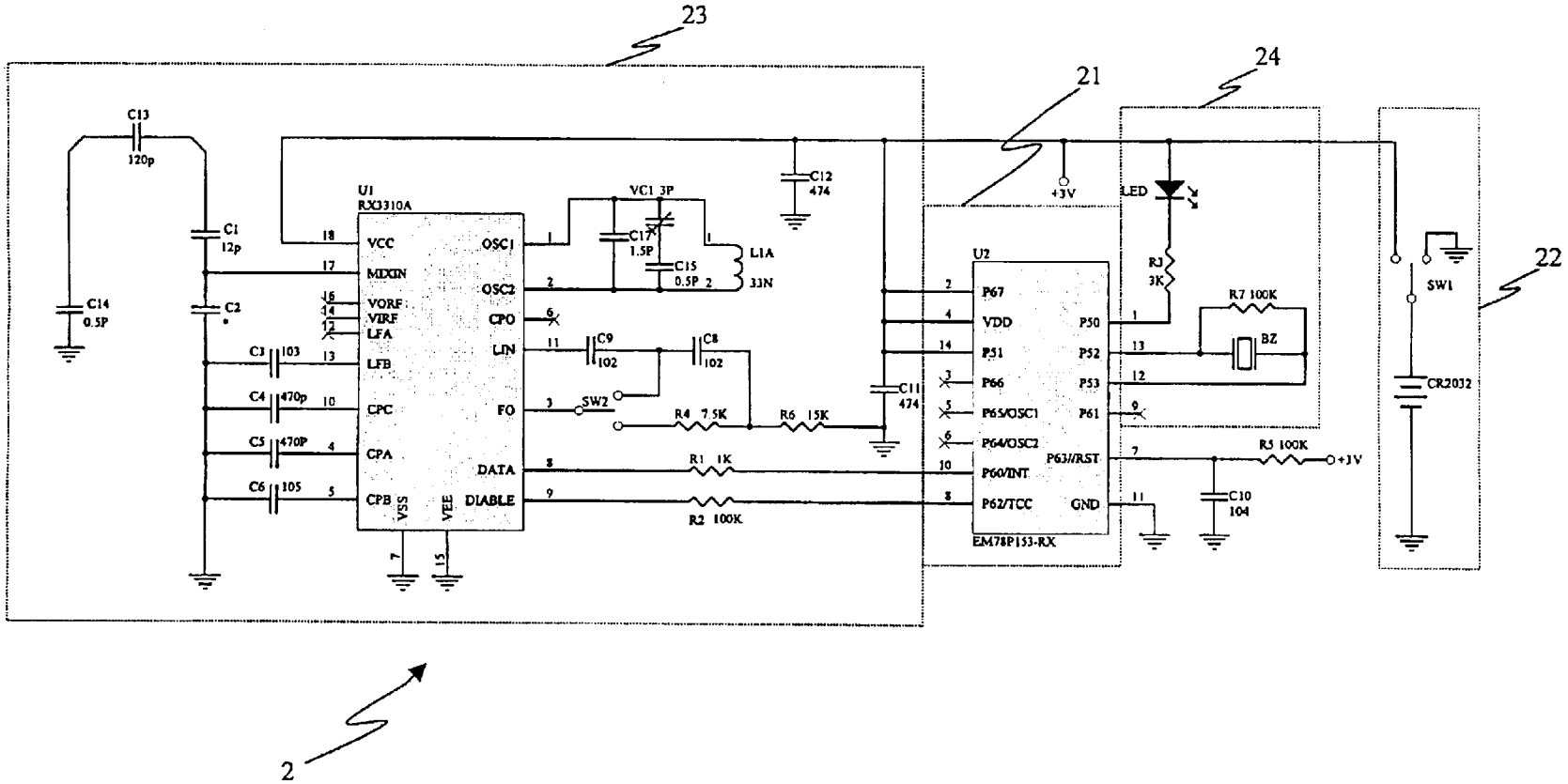
FIG. 5 is a circuit diagram view of the alarm sub-frame of the present invention.
Figure 6B:
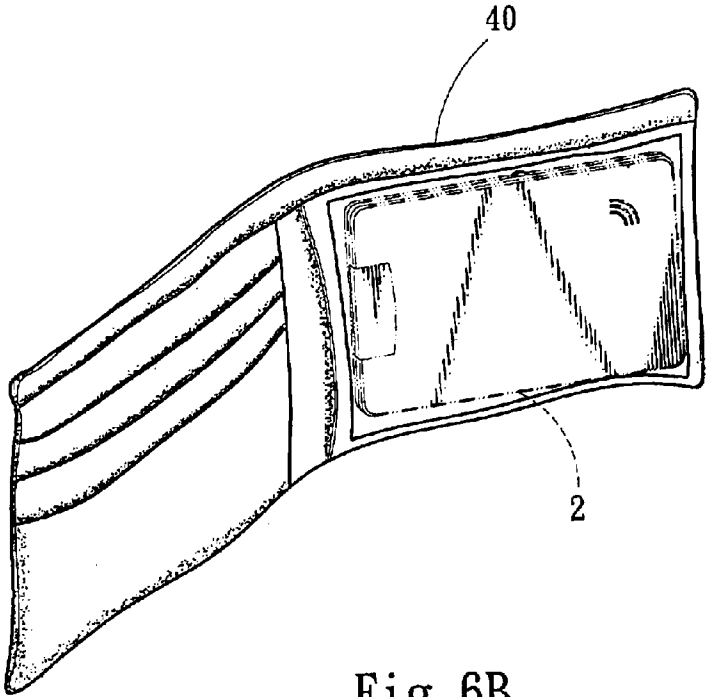
FIG. 6B shows that the alarm sub-frame of the present invention is placed in an article.
Figure 6A:
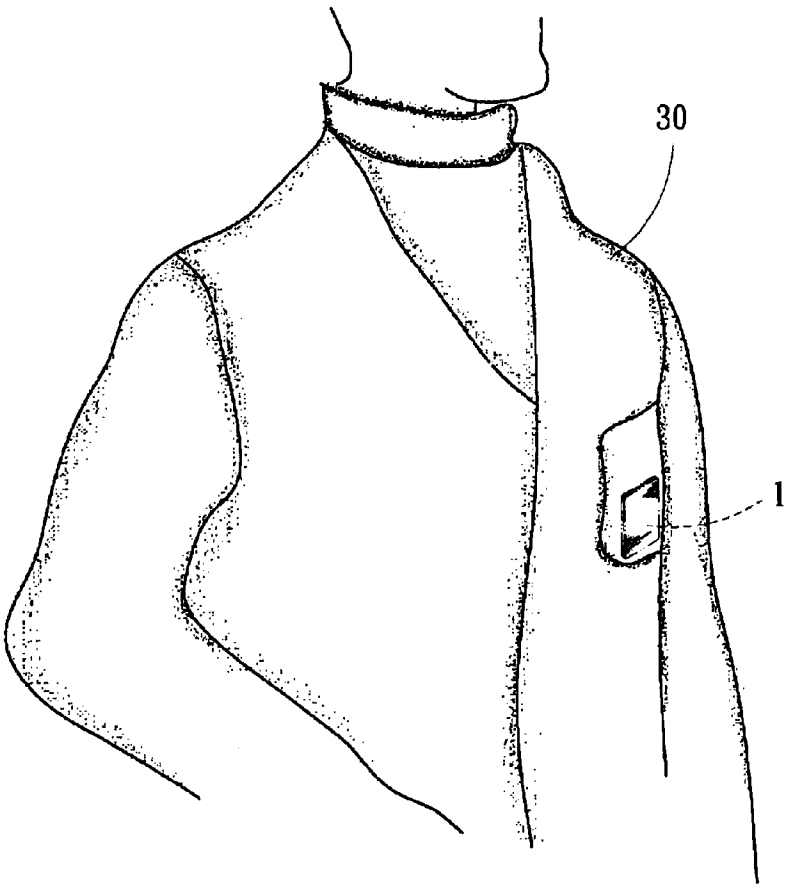
FIG. 6A shows that the portable mainframe of the present invention is carried with a user.

Referring to FIGS. 4 and 5, the alarm sub-frame 2 includes a central processing unit 21 serving as a control center, a power supply unit 22 supplying power for all the components of the sub-frame 2, a signal receiving unit 23 for receiving the radio signal wave transmitted by the mainframe 1 and a sonic/optical reminding circuit 24. In the case that the signal wave coming from the mainframe receivable by the signal receiving unit 23 is weaker than the set value, the central processing unit 21 provides a controlling signal to the sonic/optical reminding circuit 24 to emit apparent warning sound and light so as to remind the user.

By means of the separated mainframe 1 and sub-frame 2 of the present invention, it can be detected whether an important article is spaced from the user by a distance exceeding the set distance. If so, an alarm is emitted to warn the user. Both the mainframe 1 and sub-frame 2 are equipped with light emitting elements. In the case of exhaustion of power, the light emitting elements will remind the user.

Figure 7:
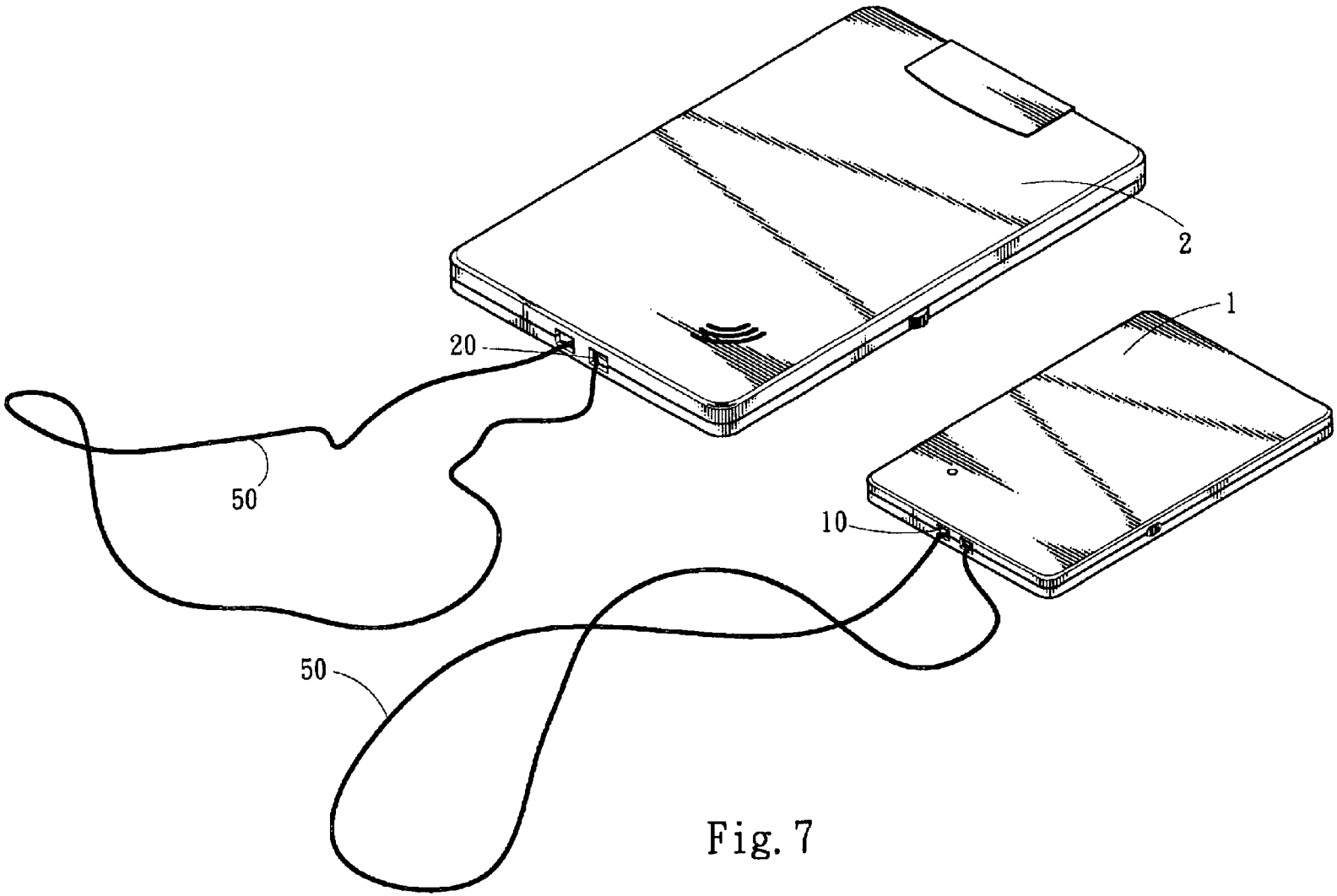
FIG. 7 shows that hanging strings are tied on the portable mainframe and alarm sub-frame of the present invention via the string holes.

In addition, referring to FIG. 7, in order to facilitate carriage, the housings of the mainframe 1 and sub-frame 2 are formed with string holes 10, 20 for tying hanging strings 50 on the mainframe 1 and sub-frame 2. Accordingly, a user can wear or hang the mainframe 1 and sub-frame 2 on his/her body.

The card-type anti-miss/anti-theft alarm device of the present invention is able to prevent an important article from missing or being stolen. Moreover, the card-type anti-miss/anti-theft alarm device of the present invention can help in finding the article. Especially, the card-type sub-frame has thin and small design and can be well hidden and more mobilely used. A thief can hardly find the card-type anti-miss/anti-theft alarm device and disassemble the same.

The above embodiments are only used to illustrate the present invention, not intended to limit the scope thereof.

Many modifications of the above embodiments can be made without departing from the spirit of the present invention.

What is claimed is:

1. A card-type anti-miss and anti-theft alarm device comprising:

a) a portable main frame having:

i) a main frame central processing unit;

ii) a main frame power supply unit connected to the main frame central processing unit and providing a main frame power supply;

iii) an intermittent oscillating transmission unit connected to the main frame central processing unit and transmitting a high frequency radio signal; and iv) an main frame optical reminding circuit connected to the main frame central processing unit and having a light emitting element emitting an optical warning when the main frame power supply from the main frame power supply unit is below a predetermined level; and b) an portable alarm sub-frame having:

i) a sub-frame central processing unit;

ii) a sub-frame power supply unit connected to the sub-frame central processing unit and providing a sub-frame power supply;

iii) a signal receiving unit connected to the sub-frame central processing unit and receiving the high frequency radio signal from the intermittent oscillating transmission unit and transmitting the high frequency radio signal to the sub-frame central processing unit; and iv) a sonic and optical reminding circuit connected to the sub-frame central processing unit and having light emitting elements, the sonic and optical reminding circuit emitting an optical warning when the sub-frame power supply from the sub-frame power supply unit is below a predetermined level and emitting an optical and an audible warning when the high frequency radio signal is below a predetermined level, wherein both of the portable alarm sub-frame and the portable main frame have a thin card design.

2. card-type anti-miss and anti-theft alarm device according to claim 1, wherein the portable main frame has a string hole.

3. The card-type anti-miss and anti-theft alarm device according to claim 1, wherein the portable alarm sub-frame has a string hole.

4. The card-type anti-miss and anti-theft alarm device according to claim 1, wherein both of the portable main frame and the portable alarm sub-frame have a string hole.

* * * * *